US008720884B2

(12) United States Patent
Araishi

(10) Patent No.: US 8,720,884 B2
(45) Date of Patent: May 13, 2014

(54) SHEET LOADING DEVICE AND IMAGE FORMING APPARATUS EQUIPPED WITH THE SAME

(71) Applicant: Kyocera Document Solutions Inc., Osaka (JP)

(72) Inventor: Kuniaki Araishi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/857,275

(22) Filed: Apr. 5, 2013

(65) Prior Publication Data

US 2013/0264766 A1 Oct. 10, 2013

(30) Foreign Application Priority Data

Apr. 9, 2012 (JP) ..... 2012-088315

(51) Int. Cl.
*B65H 1/08* (2006.01)

(52) U.S. Cl.
USPC ..... 271/147; 271/127

(58) Field of Classification Search
USPC ..... 271/145, 147, 126, 127
See application file for complete search history.

(56) References Cited

U.S. PATENT DOCUMENTS

| | | | | |
|---|---|---|---|---|
| 5,338,021 | A * | 8/1994 | Shirai | 271/160 |
| 7,267,335 | B2 * | 9/2007 | Kubo | 271/127 |
| 7,913,997 | B2 * | 3/2011 | Watanabe | 271/167 |
| 7,980,552 | B2 * | 7/2011 | Sawai | 271/126 |
| 2012/0235347 | A1 * | 9/2012 | Takiguchi | 271/109 |

FOREIGN PATENT DOCUMENTS

| | | |
|---|---|---|
| JP | 2005-015174 | 1/2005 |

* cited by examiner

*Primary Examiner* — Kaitlin Joerger
(74) *Attorney, Agent, or Firm* — K&L Gates LLP

(57) ABSTRACT

A sheet loading device positioned in an image forming apparatus includes a frame and a loading plate located on an upper surface portion of the frame. The loading plate, in association with, the upper surface portion allows the sheet to be loaded on thereon. The loading plate includes a sheet loading member that supports a downstream side of the sheet in a sheet feed direction, and can be raised and lowered with respect to a sheet transportation path, and a cover member that is located between the sheet loading member and the upper surface portion. The cover member covers a gap formed between the sheet loading member and the upper surface portion when the sheet loading member is in a raised position.

7 Claims, 4 Drawing Sheets

SHEET LOADING DEVICE AND IMAGE FORMING APPARATUS EQUIPPED WITH THE SAME

INCORPORATION BY REFERENCE

This application is based upon, and claims the benefit of priority from, corresponding Japanese Patent Application No. 2012-088315 filed in the Japan Patent Office on Apr. 9, 2012, the entire contents of which are incorporated herein by reference.

BACKGROUND

Unless otherwise indicated herein, the description in this section is not prior art to the claims in this application and is not admitted to be prior art by inclusion in this section.

This disclosure relates to sheet loading devices that are used in image forming apparatuses such as copiers, facsimile machines, and printers. Sheets, such as recording paper to be fed to the image forming apparatuses, are loaded on the sheet loading devices.

Image forming apparatuses equipped with an image forming section in which an image is formed on recording paper or a sheet-shaped film (referred to as "sheet" hereafter) are known. Generally, in such image forming apparatuses, a sheet containing unit (also referred to as a sheet feed cassette), in which a plurality of sheets are loaded, is provided. When an image is formed, sheets loaded in the sheet containing unit are fed one at a time from the sheet containing unit to the image forming section through a specified transportation path.

A loading plate, that serves as a sheet loading member, is provided in the sheet containing unit. Sheets are loaded on the loading plate. The loading plate is supported such that it can be raised and lowered with respect to a sheet feed mechanism (for example, a pick-up roller) provided in the transportation path so that the leading end of a sheet is, when an image is formed, brought into contact with the sheet feed mechanism. As an example of a technology regarding such a loading plate, a sheet feed device is known. In the sheet feed device, an end portion of the loading plate in the sheet feed direction can have a bent shape.

One end of the loading plate provided in the above-described sheet feed device is rotatably supported on a frame side of the sheet containing unit. When an image is formed, due to the loading plate being raised toward the sheet feed mechanism, a gap is formed between the loading plate and the frame of the sheet containing unit.

During image formation, when raising or lowering of the loading plate is stopped halfway for some reason, the gap remains. In this state, if the user attempts to load a sheet on the loading plate, the user may unintentionally insert the sheet into the gap. When the raising or lowering of the loading plate is started again, the sheet having been interposed between the loading plate and the frame affects operation of the loading plate similar to foreign matter and may cause problems with the loading plate and members around the loading plate. Thus, there is a need for a technology that allows the user to load a sheet at a correct position in the loading plate.

SUMMARY

A sheet loading device according to an embodiment of the present disclosure is positioned in an image forming apparatus equipped with an image forming section that forms an image on a sheet. The sheet loading device includes a frame and a loading plate located on an upper surface portion of the frame. The loading plate, in association with the upper surface portion, allows the sheet to be loaded thereon. The loading plate includes a sheet loading member that supports a downstream side of the sheet in a sheet feed direction loaded thereon, and can be raised and lowered with respect to a sheet transportation path, and a cover member that is located between the sheet loading member and the upper surface portion. The cover member covers a gap formed between the sheet loading member and the upper surface portion when the sheet loading member is in a raised position.

An image forming apparatus according to another embodiment of the present disclosure is equipped with the above-described sheet loading device.

Additional features and advantages are described herein, and will be apparent from the following Detailed Description and the figures.

DETAILED DESCRIPTION

Figure 1:
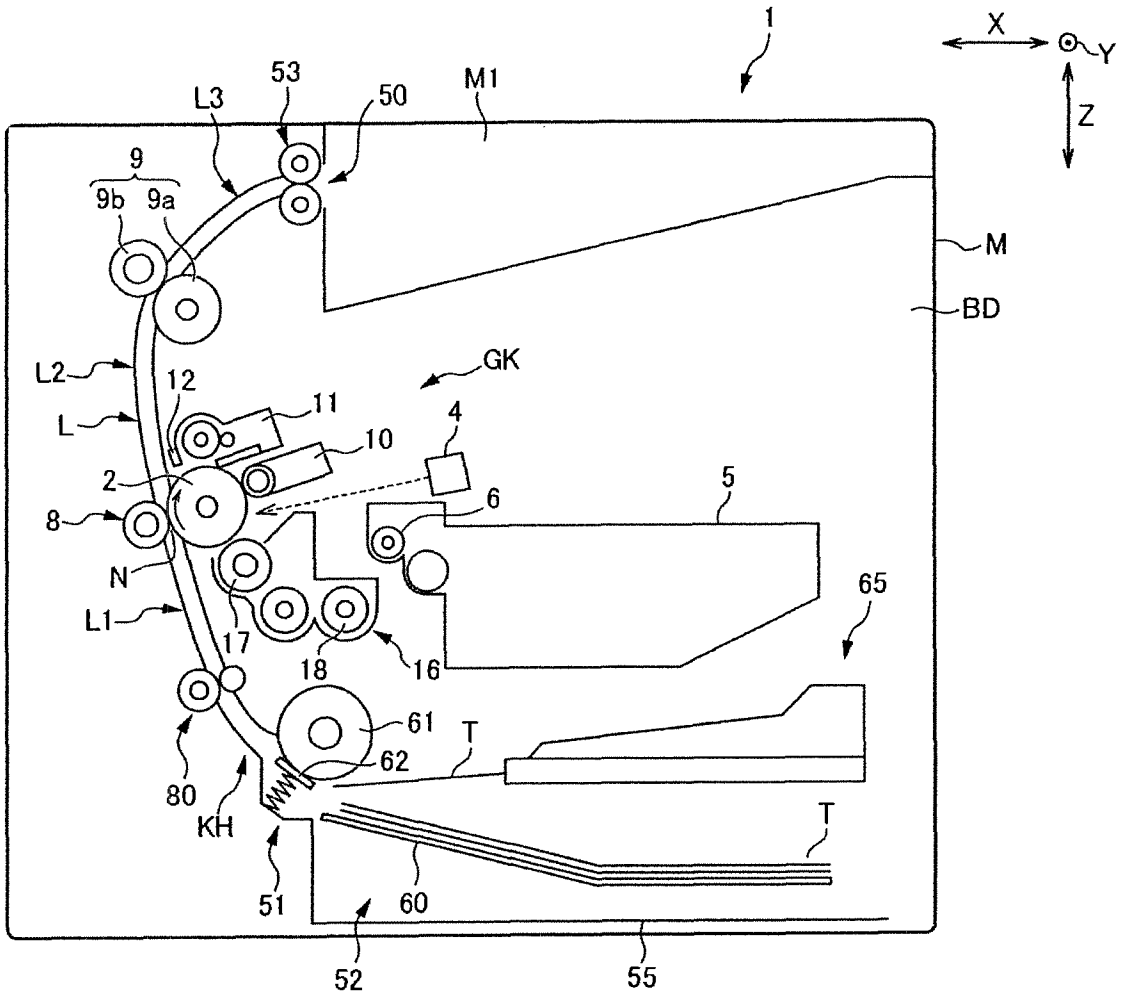
FIG. 1 illustrates a general structure and arrangement of components of a printer according to an embodiment of the present disclosure.

An example apparatus is described herein. Other example embodiments or features may further be utilized, and other changes may be made, without departing from the spirit or scope of the subject matter presented herein. In the following detailed description, reference is made to the accompanying drawings, which form a part thereof.

The embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent apparatuses and methods within the scope of the disclosure, in addition to those enumerated herein, will be apparent to those skilled in the art from the foregoing descriptions. Such modifications and variations are intended to fall within the scope of the appended claims. With respect to any or all of the ladder diagrams and flow charts in the drawings and as discussed herein, each block and/or communication may represent a process of information and/or a transmission of information in accordance with example embodiments and alternative embodiments may be included within the scope of such example embodiments. Further, more or fewer blocks and/or functions may be used with any of the ladder diagrams and flow charts discussed herein, and these ladder diagrams and flow charts may be combined with one another, in part or in whole.

An embodiment according to the present disclosure will be described below with reference to the drawings.

Referring first to FIG. 1, a general structure of a printer 1 as an image forming apparatus according to an embodiment is described. FIG. 1 illustrates a general structure for explaining the arrangement of components of the printer 1 according to an embodiment.

Figure 2:
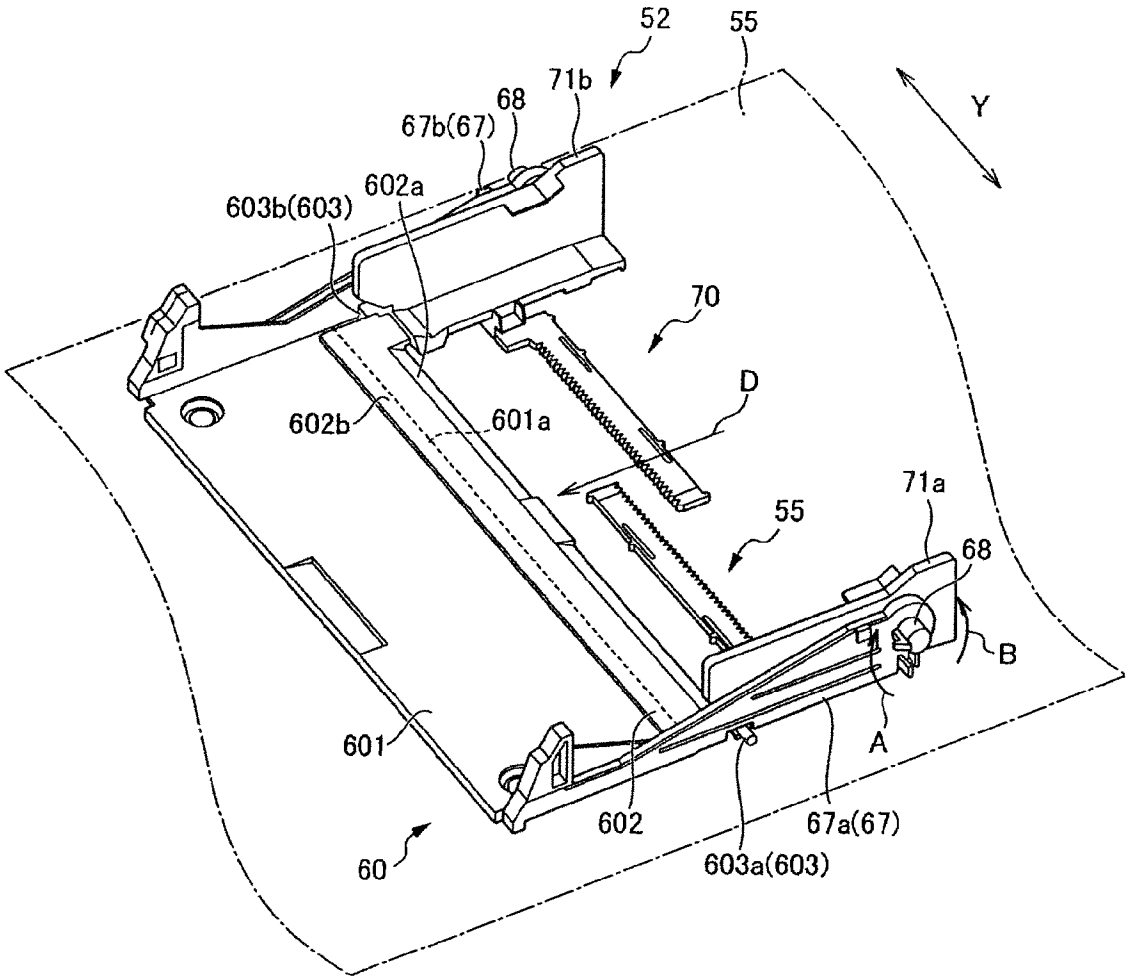
FIG. 2 illustrates a loading plate provided in a sheet containing unit and a region around the loading plate.
Figure 3:
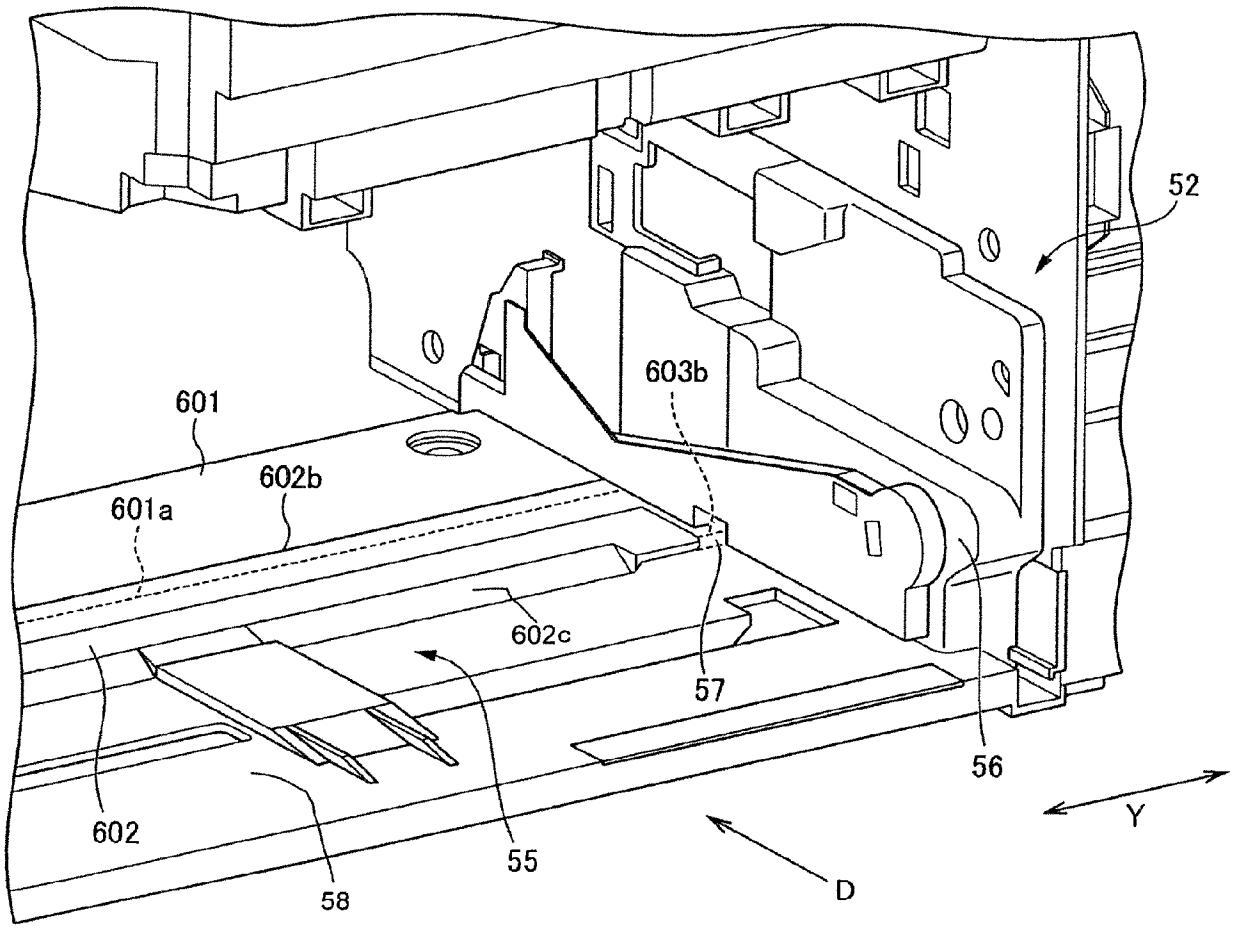
FIG. 3 is a perspective view viewed in the sheet insertion direction illustrating the loading plate of the sheet containing unit in a lowered position.
Figure 4:
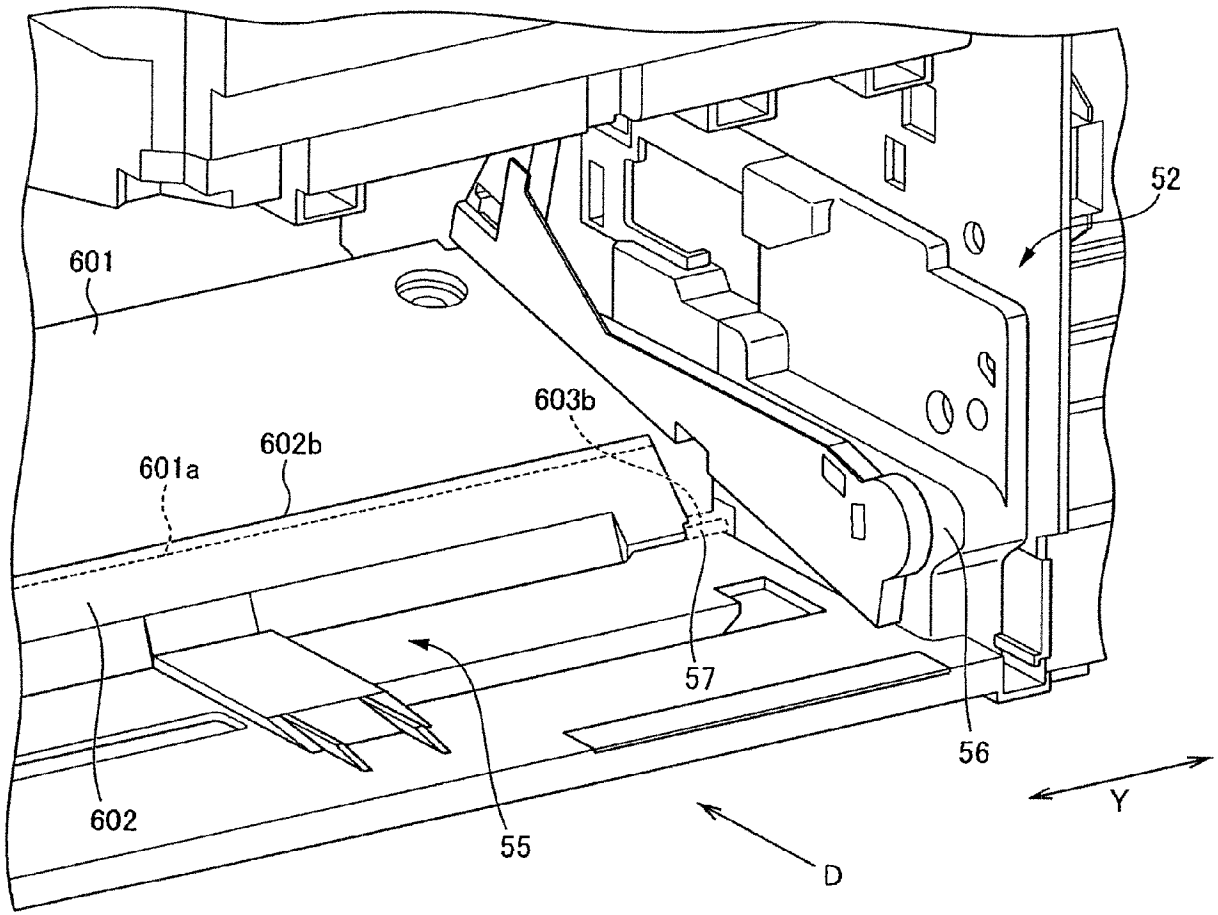
FIG. 4 is a perspective view viewed in the sheet insertion direction illustrating the loading plate of the sheet containing unit in a raised position.

In the following description, when viewed by a user standing in front of the printer 1, the left-right direction is defined as the X-direction, the front-rear (depth) direction is defined as the Y-direction, and the up-down direction (perpendicular direction) is defined as the Z-direction. The X, Y, and Z-directions are indicated in FIG. 1, and only the Y-direction is indicated in FIGS. 2 to 4.

As illustrated in FIG. 1, the printer 1 as the image forming apparatus includes an apparatus main body M, an image forming section GK, and a sheet feed and ejection section KH. The image forming section GK forms specified toner images on sheets of paper T based on specified image information. Each sheet of paper T serves as a sheet. The sheet feed and ejection section KH transports each sheet T to the image forming section GK and ejects the sheet T, on which the toner image has been formed. The contour of the apparatus main body M is defined by a casing body BD as a casing.

As illustrated in FIG. 1, the image forming section GK includes a photoconductor drum 2, a charger 10, a laser scanner unit 4, a developing device 16, a toner cartridge 5, a toner supply unit 6, a cleaning device 11, a static eliminator 12, a transfer roller 8, and a fixing unit 9. The photoconductor drum 2 serves as an image carrying body (photoreceptor) and the laser scanner unit 4 serves as an exposure unit.

Referring to FIG. 1, the sheet feed and ejection section KH includes a sheet containing unit 52, a manual feed tray 65, a transportation path L for the sheet T, a registration roller pair 80, and a sheet ejection unit 50. The sheet containing unit 52 serves as a sheet loading device.

The structures of the image forming section GK and the sheet feed and ejection section KH are described in detail below.

First, the image forming section GK will be described.

In the image forming section GK, the following processes are performed along the surface of the photoconductor drum 2 in order from the upstream to downstream sides: charging with the charger 10; light exposure with the laser scanner unit 4; developing with the developing device 16; transfer with the transfer roller 8; removal of static electricity with the static eliminator 12; and cleaning with the cleaning device 11.

The photoconductor drum 2 includes a cylindrical member and functions as a photoreceptor or an image carrying body. The photoconductor drum 2 is rotatable in the direction indicated by the arrow in FIG. 1 about a rotational axis that extends perpendicular to the transportation direction of the sheet T in the transportation path L. An electrostatic latent image can be formed on the surface of the photoconductor drum 2 using the laser scanner unit 4.

The charger 10 is positioned so as to oppose the surface of the photoconductor drum 2. The charger 10 causes the surface of the photoconductor drum 2 to be uniformly charged so it has either a negative (minus) or positive (plus) polarity.

The laser scanner unit 4 functions as an exposure unit and is spaced apart from the surface of the photoconductor drum 2. The laser scanner unit 4 includes, for example, the following components (not shown): a laser light source; a polygon mirror; and a polygon mirror drive motor.

The laser scanner unit 4 scans the surface of the photoconductor drum 2 with light based on image information inputted from external equipment such as a personal computer (PC). When the laser scanner unit 4 scans the surface of the photoconductor drum 2 with light, electric charges are removed from part of the surface of the photoconductor drum 2, the part being scanned by the light. Thus, an electrostatic latent image is formed on the surface of the photoconductor drum 2.

The developing device 16 is positioned corresponding to the photoconductor drum 2 and opposes the surface of the photoconductor drum 2. The developing device 16 causes a monochrome (typically black) toner to adhere to an electrostatic latent image formed on the surface of the photoconductor drum 2 so as to form a monochrome toner image on the surface of the photoconductor drum 2. The developing device 16 includes a developing roller 17, an agitating roller 18, and the like. The developing roller 17 opposes the surface of the photoconductor drum 2 and the agitating roller 18 agitates the toner.

The toner cartridge 5 is positioned corresponding to the developing device 16 and contains toner to be supplied to the developing device 16.

The toner supply unit 6 is positioned corresponding to the toner cartridge 5 and the developing device 16. The toner supply unit 6 supplies the toner contained in the toner cartridge 5 to the developing device 16. The toner supply unit 6 and the developing device 16 are connected to each other through a toner supply path (not shown).

The transfer roller 8 causes a toner image developed on the surface of the photoconductor drum 2 to be transferred onto the sheet T. A transfer bias is applied to the transfer roller 8 by a transfer bias application unit (not shown). The transfer bias is a voltage that causes the toner image formed on the photoconductor drum 2 to be transferred onto the sheet T. The transfer roller 8 is rotatable while being in contact with the photoconductor drum 2.

When the sheet T, having been transported through the transportation path L, is nipped between the photoconductor drum 2 and the transfer roller 8, the sheet T is pressed against the surface of the photoconductor drum 2. The toner image developed on the photoconductor drum 2 is transferred onto the sheet T in a transfer nip N formed between the photoconductor drum 2 and the transfer roller 8.

The static eliminator 12 is positioned so as to oppose the surface of the photoconductor drum 2. The static eliminator 12 removes static electricity (charge) from the surface of the photoconductor drum 2 by irradiating the surface of the photoconductor drum 2 with light after the toner image has been transferred.

The cleaning device 11 is positioned so as to oppose the surface of the photoconductor drum 2. The cleaning device 11 removes the toner and other matter remaining on or adhering to the surface of the photoconductor drum 2 and transports the removed toner and the like to a specified recovery mechanism so as to be recovered.

The fixing unit 9 fuses and presses the toner, used to form the toner image transferred onto the sheet T, so as to cause the toner to be fixed onto the sheet T. The fixing unit 9 includes a heating rotating body 9*a* and a pressing rotating body 9*b*. The heating rotating body 9*a* is heated by a heater. The pressing rotating body 9*b* is in pressure contact with the heating rotating body 9*a*. The heating rotating body 9*a* and the pressing rotating body 9*b* nip and press the sheet T, onto which the toner image has been transferred, therebetween and transport the sheet T toward the downstream side. The toner having been transferred onto the sheet T is fused and pressed so as to be fixed onto the sheet T while the sheet T nipped between the heating rotating body 9*a* and the pressing rotating body 9*b* is being transported.

Next, the sheet feed and ejection section KH will be described.

As illustrated in FIG. 1, a single sheet containing unit 52 that contains the sheets T is located in a lower portion of the apparatus main body M. The sheet containing unit 52 is open toward the right side of the apparatus main body M (on the right side in FIG. 1). The sheets T are inserted and contained in the sheet containing unit 52 through an opening portion on the right side of the sheet containing unit 52. A loading plate 60, on which the sheets T are loaded, is located in the sheet containing unit 52. The sheets T are contained in the sheet containing unit 52 such that the sheets T are stacked on the loading plate 60.

The sheets T loaded on the loading plate 60 are fed to the transportation path L by a feeding unit 51, which is located in an end portion of the sheet containing unit 52 on the sheet feeding side (end portion on the left in FIG. 1). The feeding unit 51 includes a pick-up roller 61 and separating member 62. The pick-up roller 61 feeds the sheets T loaded on the loading plate 60 one sheet at a time to the sheet transportation path L. The separating member 62 opposes and is urged toward the pick-up roller 61. The details of the sheet containing unit 52 will be described later.

As illustrated in FIG. 1, the manual feed tray 65 is located on the upper side of the sheet containing unit 52 inside the apparatus main body M. The manual feed tray 65 is mainly provided for supplying to the image forming section GK the sheets T, the size and type of which are different from those of the sheets T set in the sheet containing unit 52. The manual feed tray 65 is open toward the right side of the apparatus main body M (on the right side in FIG. 1). The sheets T are inserted and loaded in the manual feed tray 65 through an opening portion on the right side of the manual feed tray 65. A single sheet T, or a plurality of sheets T stacked one on top of another, can be loaded on the manual feed tray 65. The sheets T loaded on the manual feed tray 65 are fed to the transportation path L by the feeding unit 51.

The sheet ejection unit 50 is located on the upper side of the apparatus main body M. The sheet ejection unit 50 ejects each sheet T outside of the apparatus main body M by using a third roller pair 53.

The transportation path L, through which the sheet T is transported, has first to third transportation paths L1 to L3. The first transportation path L1 is defined as from the feeding unit 51 to the transfer nip N, the second transportation path L2 is defined as from the transfer nip N to the fixing unit 9, and the third transportation path L3 is defined as from the fixing unit 9 to the sheet ejection unit 50.

A sensor (not shown) and the registration roller pair 80 are located in the middle of the first transportation path L1 (more specifically, between the pick-up roller 61 and the transfer roller 8). The sensor detects the sheet T. The registration roller pair 80 corrects a skew of the sheet T (oblique feed of the sheet T) and adjusts the timing at which the sheet T is transported with respect to the formation of a toner image in the image forming section GK. The sensor is located immediately before (on the upstream side of) the registration roller pair 80 in the sheet T transportation direction. The registration roller pair 80 performs the above-described correction and adjustment of timing in accordance with detection signal information from the sensor so as to transport the sheet T.

The sheet ejection unit 50 is formed in an end portion on the downstream side of the third transportation path L3. The sheet ejection unit 50 is located on the upper side of the apparatus main body M. The sheet ejection unit 50 is open toward the right side of the apparatus main body M (on the right in FIG. 1). The sheet ejection unit 50 ejects the sheet T that was transported through the third transportation path L3 outside of the apparatus main body M by using the third roller pair 53.

An ejected-sheet collection portion M1 is formed on the opening side of the sheet ejection unit 50. The ejected-sheet collection portion M1 is formed on an upper surface (outer surface) of the apparatus main body M. The ejected-sheet collection portion M1 is a portion of the upper surface of the apparatus main body M, the portion of the upper surface being downwardly recessed. The bottom surface of the ejected-sheet collection portion M1 is part of the upper surface of the apparatus main body M. The sheets T, on which specified toner images have been formed and which have been ejected from the sheet ejection unit 50, are stacked on and collected in the ejected-sheet collection portion M1.

Sensors (not shown) that detect the sheet T are located at specified positions in the transportation paths.

Next, operation of the printer 1 according to an embodiment will be described with reference to FIG. 1.

Each of the sheets T contained in the sheet containing unit 52, or loaded on the manual feed tray 65, is fed to the first transportation path L1 by the feeding unit 51, and after that, transported to the registration roller pair 80 through the first transportation path L1. In the registration roller pair 80, skew of the sheet T is corrected and the timing with respect to a toner image is adjusted.

The sheet T ejected from the registration roller pair 80 is introduced into the nip (transfer nip N) between the photoconductor drum 2 and the transfer roller 8 through the first transportation path L1. A toner image is transferred onto the sheet T in the nip between the photoconductor drum 2 and the transfer roller 8.

After that, the sheet T is fed from the nip between the photoconductor drum 2 and the transfer roller 8 and is directed to a fixing nip between the heating rotating body 9*a* and the pressing rotating body 9*b* of the fixing unit 9 through the second transportation path L2. In the fixing nip, the toner is fused and fixed to the sheet T.

Next, the sheet T is transported to the sheet ejection unit 50 through the third transportation path L3 and ejected from the sheet ejection unit 50 to the ejected-sheet collection portion M1 by the third roller pair 53.

Thus, printing performed on the sheet T contained in the sheet containing unit 52 or loaded on the manual feed tray 65 is completed.

Next, the structure of the above-described sheet containing unit 52 of the printer 1 is described below with reference to the drawings. FIG. 2 illustrates the structure of the loading plate 60 positioned in the sheet containing unit 52 and a structure around the loading plate 60. FIG. 3 is a perspective view viewed from the sheet T insertion direction illustrating the loading plate 60 of the sheet containing unit 52 in a lowered position. FIG. 4 is a perspective view viewed from the sheet T insertion direction illustrating the loading plate 60 of the sheet containing unit 52 in a raised position.

As illustrated in FIG. 2, the sheet containing unit 52 mainly includes a frame 55, the loading plate 60, a support unit 67, and a cursor unit 70.

The frame 55 is a casing in which components of the sheet containing unit 52 are located. The loading plate 60 is positioned on an upper surface portion 58 of the frame 55.

The loading plate 60 includes a first loading plate 601 as a sheet loading member and a second loading plate 602 as a cover member.

The first loading plate 601 has a flat plate shape on which a single or a plurality of the sheets T are loaded. In the first loading plate 601, support arms 67*a* and 67*b* of the support unit 67 are located in both end portions in the width direction (may also be referred to as the "sheet T width direction Y" hereafter) perpendicular to the sheet T feed direction D.

The support unit 67 supports the first loading plate 601 such that the first loading plate 601 is rotatable. The support unit 67 includes a pair of the support arms 67*a* and 67*b*. The support arms 67*a* and 67*b* each have a rotational shaft 68 at an end portion on the upstream side in the sheet T feed direction D. The rotational shafts 68 are fitted into respective shaft engagement portions 56 (see FIGS. 3 and 4) provided in the frame 55. The support unit 67 when the rotational shafts 68 are fitted into the shaft engagement portions 56 of the frame 55 is rotated clockwise or counterclockwise about the rotational shafts 68 by a drive mechanism (not shown) located in the printer 1.

The above-described drive mechanism for the loading plate 60 includes a spring (not shown) that urges the first loading plate 601 upward and a cam (not shown) provided on a rotational shaft of the pick-up roller 61. In this drive mechanism, when the cam is rotated together with rotation of the pick-up roller 61 and brought into contact with the first loading plate 601, the first loading plate 601 is pushed down by the cam against the urging force applied by the spring and is lowered. When the cam is rotated together with the rotation of the pick-up roller 61 and brought out of contact from the first loading plate 601, the first loading plate 601 is pushed up due to the urging force applied by the spring and raised. When the pick-up roller 61 is stopped, the first loading plate 601 is stopped at a position where the first loading plate 601 is pushed downward and lowered by the cam. Operation of the drive mechanism will be described later.

When the first loading plate 601 is in the lowered position on the upper surface of the frame 55 as illustrated in FIG. 2, rotation of the support unit 67 about the rotational shafts 68 clockwise (arrow A direction) viewed from the front side of the page of FIG. 2 raises (moves upward) the first loading plate 601. When the first loading plate 601 is in the raised position, rotation of the support unit 67 about the rotational shafts 68, counterclockwise (arrow B direction) viewed from the front side of the page of FIG. 2, lowers (moves downward) the first loading plate 601. When the first loading plate 601 is in the raised position, the sheet T loaded on the first loading plate 601 is transported toward the transportation path L by the pick-up roller 61 (see FIG. 1). Thus, the support unit 67 supports the first loading plate 601 such that the first loading plate 601 can be raised and lowered with respect to the transportation path L, through which the sheet T is transported to the image forming section GK (see FIG. 1).

The second loading plate 602 is the cover member that covers the gap formed between the first loading plate 601 and the frame 55 and has a flat plate shape. The length of the second loading plate 602 in the sheet T feed direction D is shorter than that of the first loading plate 601. The second loading plate 602 has a pair of rotational shafts 603*a* and 603*b* (also referred to as "rotational shaft 603") at both ends in the sheet T width direction Y in an end portion 602*a* thereof on the upstream side in the sheet T feed direction D. Furthermore, an inclined surface 602*c* is formed in the end portion 602*a* on the upstream side in a transportation region between the both end portions in the sheet T width direction Y. The inclined surface 602*c* is upwardly inclined toward the downstream side in the sheet T feed direction D. As illustrated in FIGS. 3 and 4, the rotational shaft 603 is fitted into shaft engagement portions 57 provided in the frame 55. Thus, the second loading plate 602 is supported by the frame 55 in the end portion 602*a* on the upstream side in the sheet T feed direction D by using pair of rotational shafts 603*a* and 603*b*.

Although FIGS. 3 and 4 illustrate a state where the rotational shaft 603*b*, which is one of the pair of rotational shafts of the second loading plate 602, is fitted into a corresponding one of the shaft engagement portions 57 of the frame 55, the rotational shaft 603*a*, which is the other one of the pair of rotational shafts of the second loading plate 602, is also fitted into a corresponding one of the shaft engagement portions 57 of the frame 55. Neither the rotational shaft 603*a* nor the corresponding shaft engagement portion 57 is shown in FIGS. 3 and 4.

As illustrated in FIG. 2, an end portion 602*b* of the second loading plate 602 located on the downstream side in the sheet T feed direction D is engaged with the end portion 601*a* of the first loading plate 601 located on the upstream side in the sheet T feed direction D. More specifically, the end portion 602*b* of the second loading plate 602 is engaged with the end portion 601*a* of the first loading plate 601 so that the end portion 602*b* overlaps the end portion 601*a*. Thus, the second loading plate 602 is engaged with the first loading plate 601 in the end portion 602*b* thereof on the downstream side in the sheet T feed direction D and rotatably supported by the frame 55 in the end portion 602*a* thereof on the upstream side in the sheet T feed direction D. Operation of the second loading plate 602 will be described later.

The cursor unit 70 adjusts the position of the sheet T loaded on the first loading plate 601. As illustrated in FIG. 2, the cursor unit 70 is positioned between the components of the support unit 67. The cursor unit 70 includes a pair of guide plates 71*a* and 71*b* on each side in the sheet T width direction Y, respectively. The guide plates 71*a* and 71*b* are movable in the sheet T width direction Y. The user can adjust the position of the sheet T loaded on the first loading plate 601 based on the size of the sheet T by moving the guide plates 71*a* and 71*b* of the cursor unit 70 in the sheet T width direction Y.

Next, operation of the sheet containing unit 52 structured as stated above will be described.

The user loads the sheet T in the sheet containing unit 52 before image formation is performed in the image forming section GK. The sheet T is loaded while the first loading plate 601 and the second loading plate 602 are lowered in the sheet containing unit 52 as illustrated in FIG. 3. The user can load the required number of sheets T in the sheet containing unit 52.

Next, when the user pushes the start button (not shown) or the like of the printer 1, and accordingly, image formation is performed in the image forming section GK, the cam rotates in the drive mechanism (not shown) of the loading plate 60 along with the pick-up roller 61, thereby separating the cam from the first loading plate 601. Thus, the first loading plate 601 of the sheet containing unit 52 is pushed upward and raised by the urging force of the spring and, as illustrated in FIG. 4, urged toward the pick-up roller 61 side. When the first loading plate 601 is raised, the end portion 602*b* of the second loading plate 602 is pushed upward by the end portion 601*a* of the first loading plate 601. As a result, the second loading plate 602 is upwardly rotated about the rotational shaft. In this state, the sheets T loaded on the first loading plate 601 is fed one at a time by the pick-up roller 61 (see FIG. 1) and transported to the transportation path L (see FIG. 1).

When the pick-up roller 61 is further rotated, the cam is rotated along with the pick-up roller 61 and brought into contact with the first loading plate 601 again. Thus, the first loading plate 601 of the sheet containing unit 52 is pushed downward against the urging force of the spring and, as illustrated in FIG. 3, and lowered toward the frame 55 side. Due to the raising and lowering of the first loading plate 601 in conjunction with the rotation of the pick-up roller 61 as described above, the specified number of the sheets T loaded in the sheet containing unit 52 are fed one sheet after another. When rotation of the pick-up roller 61 is stopped due to a sheet jam or the like during rotation of the pick-up roller 61, the first loading plate 601 stops at the position where the first loading plate 601 was positioned at the time when rotation of the pick-up roller 61 was stopped.

In printers equipped with related art sheet containing units, when a loading plate of the sheet containing unit is raised, or the raising or lowering of the loading plate is stopped halfway for some reason, a gap is formed between the loading plate and a frame.

In contrast, in the printer 1 equipped with the sheet containing unit 52 according to an embodiment of the present disclosure, when the first loading plate 601 of the sheet containing unit 52 is raised, or raising or lowering of the first loading plate 601 is stopped halfway for some reason, the gap formed between the first loading plate 601 and the frame 55 is closed by the second loading plate 602. Thus, when the user attempts to load the sheet T on the first loading plate 601 that is stopped, the sheet T cannot be inserted into the gap formed between the first loading plate 601 and the frame 55. That is, even when the sheet T inserted by the user reaches a position where the gap between the first loading plate 601 and the frame 55 is formed, a leading end portion of the sheet T is brought into contact with the second loading plate 602 and directed along the inclined surface of the second loading plate 602 toward the first loading plate 601. Accordingly, in the printer 1 according to an embodiment of the present disclosure, the user can load the sheet T at a correct position on the first loading plate 601 when the first loading plate 601 is stopped at any position.

With the printer 1 according to the embodiment set forth above, the following advantages, for example, are achieved.

In the printer 1 according to an embodiment, the sheet containing unit 52 includes the second loading plate 602 (cover member) that covers the gap formed between the first loading plate 601 and the frame 55 at least when the first loading plate 601 (sheet loading member) is in the raised position.

With this structure, when the first loading plate 601 of the sheet containing unit 52 is raised, or raising or lowering of the first loading plate 601 is stopped halfway for some reason, the gap formed between the first loading plate 601 and the frame 55 is closed by the second loading plate 602. For this reason, a sheet T inserted by the user will not be inserted into the gap formed between the first loading plate 601 and the frame 55. Accordingly, in the printer 1, the user can load the sheet T (sheet) at a correct position on the first loading plate 601 when the first loading plate 601 is stopped at any position.

The number of sheets T that can be loaded in the sheet containing unit 52 differs depending on the type of the apparatus. As the number of sheets T that can be loaded in the sheet containing unit 52 increases, the size of the gap formed between the first loading plate 601 and the frame 55 when the first loading plate 601 is raised increases. Thus, in prior art printers that are not equipped with the second loading plate 602 in the sheet containing unit, when the loading plate is raised, the sheet T loaded on the loading plate slips in a direction opposite to the sheet T feed direction D. This may affect sheet feeding performance.

In the printer 1 equipped with the sheet containing unit 52 according to an embodiment, the second loading plate 602 is located between the first loading plate 601 and the frame 55. For this reason, the sheet T loaded on the first loading plate 601 is not only in contact with the first loading plate 601, but also in contact with the second loading plate 602. Thus, the area in which the sheet T and the loading plate 60 are in contact with each other is increased. Accordingly, the printer 1 can stably hold the sheet T in the sheet containing unit 52.

When the first loading plate 601 of the sheet containing unit 52 is raised, or raising or lowering of the first loading plate 601 is stopped halfway for some reason, even when raising or lowering of the first loading plate 601 is suddenly started, the second loading plate 602 restricts insertion of the finger or hand of the user or tools or the like into the gap. Thus, problems caused by insertion of the finger or hand of the user or tools or the like can be substantially avoided.

In the sheet containing unit 52 according to an embodiment, the second loading plate 602 is engaged with the first loading plate 601 at the end portion 602*b* thereof on the downstream side in the sheet T (sheet) feed direction D and rotatably supported by the frame 55 in the end portion 602*a* thereof on the upstream side in the sheet T feed direction D.

With this structure, the second loading plate 602 is supported at the end portion 602*a* on the frame 55 side. Thus, even when a large number of sheets T are loaded, twisting or bending of the sheets T that can occur when the second loading plate 602 is rotated is suppressed. Accordingly, the second loading plate 602 can be more smoothly rotated.

Since the end portion 602*b* of the second loading plate 602 is only placed on the end portion 601*a* of the first loading plate 601, a drive mechanism that moves the second loading plate 602 is not required. This can simplify the structure of the loading plate 60.

Although an embodiment of the present invention has been described, the present invention is not limited to the embodiment stated above and may be implemented in a variety of forms.

For example, in the above embodiment, the second loading plate 602 is engaged with the first loading plate 601 at the end portion 602*b* thereof on the downstream side in the sheet T feed direction D and rotatably supported by the frame 55 at the end portion 602*a* thereof on the upstream side in the sheet T feed direction D. The structure of the second loading plate 602 is not so limited. The second loading plate 602 may be rotatably supported by the first loading plate 601 at the end portion 602*b* thereof on the downstream side in the sheet T feed direction D and engaged with the frame 55 at the end portion 602*a* thereof on the upstream side in the sheet T feed direction D.

With such a structure, the loading plate 60 can be attached to the frame 55 with the first loading plate 601 and the second loading plate 602 connected to each other in advance. This facilitates assembly of the sheet containing unit 52. Furthermore, since a shaft engagement portion that supports the second loading plate 602 is not required on the frame 55 side, the structure of the frame 55 can be simplified.

In the above embodiment, the second loading plate 602, as the cover member, has a flat plate shape. However, the shape of the second loading plate 602 is not limited to this example and may be appropriately selected as long as the second loading plate 602 can close the gap formed between the first loading plate 601 and the frame 55. For example, the second loading plate 602 may be formed of a mesh-shaped or grid-shaped member. In the situation where only insertion of the sheet T into the gap is needed to be blocked, the length of the second loading plate 602 in the sheet T width direction Y can be further reduced.

In the above embodiment, an example is described, in which the present disclosure is applied to the sheet containing unit 52 located in the apparatus main body M. However, this does not limit application of the present disclosure. The present disclosure may be applied to a sheet feed cassette that is detachably positioned in the apparatus main body M. The present disclosure may also be applied to the manual feed tray 65 located in the apparatus main body M. In this case, the manual feed tray 65 may alternatively be positioned externally to the apparatus main body M. Furthermore, the present disclosure may also be applied, for example, to a document feeding device that feeds (transports) a document, which is a sheet on which an image has been formed, toward the image forming section GK.

In the above embodiment, the monochrome printer 1 is described as an image forming apparatus. However, the image forming apparatus is not so limited. The image forming apparatus may be a copier, a color printer, a facsimile machine, a multi-function machine having the functions of these devices, or the like.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A sheet loading device positioned in an image forming apparatus, the image forming apparatus being equipped with an image forming section that forms an image on a sheet, the sheet loading device comprising:

a frame; and a loading plate located on an upper surface portion of the frame, the loading plate, in association with the upper surface portion, allowing the sheet to be loaded thereon, the loading plate includes a sheet loading member that supports a downstream side of the sheet in a sheet feed direction, and is able to be raised and lowered with respect to a sheet transportation path, and a cover member that is located between the sheet loading member and the upper surface portion and covers a gap formed between the sheet loading member and the upper surface portion when the sheet loading member is in a raised position, wherein the cover member is a plate-shaped member that extends in a sheet width direction and has a first end portion and a second end portion respectively located on an upstream side and the downstream side in the sheet feed direction, and wherein the first end portion is rotatably supported by the frame, and a lower surface of the second end portion overlaps an upper surface of an end portion of the sheet loading member.

2. The sheet loading device according to claim 1, wherein the first end portion is located on the upstream side in the sheet feed direction, and an inclined surface that rises in the sheet feed direction is formed in the first end portion.

3. The sheet loading device according to claim 1, wherein an inclined surface that rises in the sheet feed direction is formed in the first end portion.

4. An image forming apparatus equipped with a sheet loading device and an image forming section that forms an image on a sheet, the sheet loading device includes a frame, and a loading plate positioned on an upper surface portion of the frame, the loading plate, in association with the upper surface portion, allowing the sheet to be loaded thereon, the loading plate includes a sheet loading member that supports a downstream side of the sheet in a sheet feed direction, and can be raised and lowered with respect to a sheet transportation path, and a cover member that is located between the sheet loading member and the upper surface portion and covers a gap formed between the sheet loading member and the upper surface portion when the sheet loading member is in a raised position, wherein the cover member is a plate-shaped member that extends in a sheet width direction and has a first end portion and a second end portion respectively located on an upstream side and the downstream side in the sheet feed direction, and wherein the first end portion is rotatably supported by the frame, and a lower surface of the second end portion overlaps an upper surface of an end portion of the sheet loading member.

5. A sheet loading device positioned in an image forming apparatus, the image forming apparatus being equipped with an image forming section that forms an image on a sheet, the sheet loading device comprising:

a frame; and a loading plate located on an upper surface portion of the frame, the loading plate, in association with the upper surface portion, allowing the sheet to be loaded thereon, the loading plate includes a sheet loading member that supports a downstream side of the sheet in a sheet feed direction, and is able to be raised and lowered with respect to a sheet transportation path, and a cover member that is located between the sheet loading member and the upper surface portion and covers a gap formed between the sheet loading member and the upper surface portion when the sheet loading member is in a raised position, wherein the cover member is a plate-shaped member that extends in a sheet width direction and has a first end portion and a second end portion respectively located on an upstream side and the downstream side in the sheet feed direction, and wherein the second end portion is rotatably supported by an end portion of the sheet loading member and the first end portion is in contact with the upper surface portion.

6. A sheet loading device positioned in an image forming apparatus, the image forming apparatus being equipped with an image forming section that forms an image on a sheet, the sheet loading device comprising:

a frame; and a loading plate located on an upper surface portion of the frame, the loading plate, in association with the upper surface portion, allowing the sheet to be loaded thereon, the loading plate includes a sheet loading member that supports a downstream side of the sheet in a sheet feed direction, and is able to be raised and lowered with respect to a sheet transportation path, and a cover member that is located between the sheet loading member and the upper surface portion and covers a gap formed between the sheet loading member and the upper surface portion when the sheet loading member is in a raised position, wherein the cover member has a first end portion located on an upstream side in the sheet feed direction, and an inclined surface that rises in the sheet feed direction is formed in the first end portion.

7. The sheet loading device according to claim 5, wherein an inclined surface that rises in the sheet feed direction is formed in the first end portion.

* * * * *